US011731089B2

(12) United States Patent
Mordec et al.

(10) Patent No.: US 11,731,089 B2
(45) Date of Patent: Aug. 22, 2023

(54) SYSTEM AND A METHOD FOR PRODUCING A LIQUID WITH GAS BUBBLES

(71) Applicant: MBA S.A., Mielec (PL)

(72) Inventors: Wojciech Mordec, Mielec (PL); Jean Philippe Francisci, Warsaw (PL); Aneta Maria Werynska, Mielec (PL)

(73) Assignee: MBA S.A., Mielec (PL)

( * ) Notice: Subject to any disclaimer, the term of this patent is extended or adjusted under 35 U.S.C. 154(b) by 123 days.

(21) Appl. No.: 17/497,944

(22) Filed: Oct. 10, 2021

(65) Prior Publication Data

US 2022/0126243 A1 Apr. 28, 2022

(30) Foreign Application Priority Data

Oct. 27, 2020 (EP) ..... 20461574

(51) Int. Cl.
*B01F 3/04* (2006.01)
*B01F 23/231* (2022.01)
*B01F 23/23* (2022.01)
*B01F 35/71* (2022.01)

(52) U.S. Cl.
CPC .... *B01F 23/23105* (2022.01); *B01F 23/2366* (2022.01); *B01F 35/7176* (2022.01)

(58) Field of Classification Search
CPC ..... B01F 23/23105; B01F 23/2366; B01F 35/7176; B01F 23/2322; B01F 23/232312; B01F 23/2326; B01F 23/2375; B01F 25/3131; B01F 25/433
USPC ..... 261/36.1, 76
See application file for complete search history.

(56) References Cited

U.S. PATENT DOCUMENTS 6,054,048 A * 4/2000 Kaeriyama ..... C02F 3/1294 210/220
7,913,984 B2 * 3/2011 Noguchi ..... B01F 25/50 261/36.1
2002/0163089 A1 * 11/2002 La Crosse ..... B01F 33/811 261/76
2007/0257381 A1 * 11/2007 Chuang ..... B01F 25/60 261/76
2011/0156287 A1 * 6/2011 Tsai ..... B01F 25/45211 261/28
2020/0114320 A1 * 4/2020 Sohn ..... C02F 1/68

* cited by examiner

*Primary Examiner* — Charles S Bushey
(74) *Attorney, Agent, or Firm* — Mark M. Friedman

(57) ABSTRACT

A system for producing a liquid with gas bubbles. The system has an eductor to mix a liquid stream and a gas stream to a form of a liquid-gas mixture and a mixing column with a stack of filling layers to reduce a size of gas bubbles within the liquid-gas mixture. The stack of filling layers has a plurality of porous layers separated alternately by plate layers and ring layers.

14 Claims, 3 Drawing Sheets

SYSTEM AND A METHOD FOR PRODUCING A LIQUID WITH GAS BUBBLES

TECHNICAL FIELD

The present invention relates to a system and a method for producing a liquid having gas bubbles, preferably of nano sizes, depending on the desired use of the obtained liquid.

BACKGROUND

Liquids (such as water) with gas bubbles, especially those containing stable nanobubbles of gas or a mixture of various gases, can be used for various applications including medicinal purposes, biocidal activity, virucidal activity, and sterilizing effect, cleaning of various surfaces, as well as wastewater management.

The usefulness of water with gas nanobubbles and/or microbubbles depends on the size and concentration of the bubbles as well as on the nature of the gas (or gas mixture) that forms the bubbles.

Microbubbles as referred to in this description are bubbles of a diameter from 1 to 100 micrometers. Nanobubbles are bubbles of a diameter from 1 to 999 nanometers. At such small size, gas bubbles present different physicochemical and fluid dynamic properties than ordinary gas macrobubbles as commonly found in water with gas. Generally, the gas macro bubbles range from 100 μm to 2 mm. In particular, nanobubbles which are less than 100 nm in diameter have a lower buoyancy, and they can remain suspended in liquids for an extended period.

The microbubbles and nanobubbles have a large specific area and high pressurization of gas inside the bubble, which confer to high gas dissolution capability of these bubbles. The nanosized and microsized bubbles, can be present in water of a wide pH range, in particular of pH from 2 to 12 (preferably 7 for better equilibrium), and can have negatively charged surface neutralized by the presence of cations e.g. $Na^+$, $Ca^{2+}$, $Mg^{2+}$, etc. in the water, thereby, maintaining the bubbles in a stable form.

Generally, the gas bubbles in water can be generated by dissolving gas with pressure and releasing the gas while reducing pressure. Devices for generating gas bubbles using this method comprise a water pump, an air compressor, and an air tank. The water pump provides a certain pressure to send the circulating water to the dissolved gas tank, and the air compressor presses the air into the dissolved gas tank. The high-pressure gas-water mixing state, formed in the dissolved gas tank, makes the gas supersaturated and dissolved, and then the gas is precipitated out of the water in the form of nano and/or microbubbles by sudden decompression.

Furthermore, nanobubbles are often formed in water when a homogeneous liquid phase undergoes a phase change due to a sudden pressure drop below a critical value, known as cavitation. Usually, cavitation is formed by the passage of ultrasonic waves or changes in high pressure in a running fluid, typically called hydrodynamic cavitation.

Other known methods for generation nanobubbles in water include ultrasonication, and chemical reactions such as electrolysis, e.g. based on the palladium electrode.

Also, a Venturi-type generator is widely used to generate nanobubbles in water. In this system liquid and gas are transmitted simultaneously through the Venturi tube to generate the bubbles. When the pressurized liquid is injected into the tubular part of the Venturi tube, the flow of fluid into the cylindrical throat becomes higher, while the pressure becomes lower than the input section, leading to cavitation.

SUMMARY

The distribution and size of gas microbubbles and nanobubbles in water depend on the system used and its operational mode. In general, this is associated with the pressure changes across the nozzle system, whereas the more the pressure, the smaller the bubble size due to the increase in density of the gas used.

However, increased operational pressure usually requires increased outlays to provide enhanced apparatus adapted to work at high pressures and changes of the pressure across the system. Also, high-pressure working conditions may generate additional maintenance costs due to faster wear and tear of the system elements.

Therefore, there is a need to provide an improved system for producing liquid with gas bubbles that allows obtaining high concentration of the gas bubbles, in particular microbubbles and nanobubbles. It would be advantageous to provide a system that is compact and could provide improved mixing of water and gas without further increase of pressure.

In one aspect, the invention relates to a system for producing a liquid with gas bubbles, the system comprising: a liquid inlet to receive a liquid stream, a gas inlet to receive a gas stream, an eductor configured to mix the liquid stream and the gas stream to a form of a liquid-gas mixture and a mixing column. The mixing column comprises: an input configured to receive the liquid-gas mixture from the eductor, an output, and a stack of filling layers positioned between the input and the output, configured to reduce a size of gas bubbles within the liquid-gas mixture as it flows from the input to the output, the stack of filling layers comprising a plurality of porous layers separated alternately by: plate layers made of a first impermeable material, each plate layer having a shape of a plate distanced by a clearance from an internal wall of the mixing column to allow the liquid-gas mixture to flow from one porous layer to its neighboring porous layer via the clearance, and ring layers made of a second impermeable material, each ring layer having a form of a ring that has a central flow-through aperture to allow the liquid-gas mixture to flow from one porous layer to its neighboring porous layer via the aperture.

The ring layers can be made of steel.

The ring layers can be made of stainless steel.

The plate layers can be made of rubber.

The plate layers can be made of polytetrafluoroethylene (PTFE).

The mixing column may comprise from 2 to 10 porous layers.

The eductor may comprise a liquid pipe having an upstream section connected to the liquid inlet and a downstream section having an outlet to discharge the liquid-gas mixture; and a suction pipe having an upstream section connected to the gas inlet and a suction nozzle arranged in the liquid pipe across a lumen of the liquid pipe, wherein the suction nozzle comprises at least one opening facing the downstream section of the liquid pipe.

The system may further comprise an impeller pump configured to pump the liquid-gas mixture from the eductor into the mixing column.

The system may further comprise a filter arranged at the liquid inlet to filter the liquid stream.

In another aspect, the invention relates to a method for producing a liquid with gas bubbles, the method comprising the steps of: providing a liquid stream, providing a gas stream, mixing the liquid stream and the gas stream in an eductor to obtain a liquid-gas mixture, and passing the liquid-gas mixture via a mixing column. The mixing column comprises an input configured to receive the liquid-gas mixture from the eductor, an output, and a stack of filling layers positioned between the input and the output, configured to reduce a size of gas bubbles within the liquid-gas mixture as it flows from the input to the output, the stack of filling layers comprising a plurality of porous layers separated alternately by: plate layers made of a first impermeable material, each plate layer having a shape of a plate distanced by a clearance from an internal wall of the mixing column to allow the liquid-gas mixture to flow from one porous layer to its neighboring porous layer via the clearance, and ring layers made of a second impermeable material, each ring layer having a form of a ring that has a central flow-through aperture to allow the liquid-gas mixture to flow from one porous layer to its neighboring porous layer via the aperture.

The method may comprise passing the liquid-gas mixture via the mixing column in a flow-through manner.

The method may comprise passing the liquid-gas mixture via the mixing column in a closed-loop manner.

The method may comprise passing the liquid-gas mixture via the mixing column with a pressure sufficient to cause division and multiplication of gas bubbles as the liquid-gas mixture passes through the porous layers.

The method may comprise passing the liquid-gas mixture via the mixing column such that compression, expansion and vortexes are generated within the liquid-gas mixture to produce gas bubbles in the water.

BRIEF DESCRIPTION OF THE DRAWINGS

These and other objects of the invention presented herein, are accomplished by providing a system and method for production water with gas bubbles. Further details and features of the present invention, its nature and various advantages will become more apparent from the following detailed description of the preferred embodiments shown in a drawing, in which.

DETAILED DESCRIPTION

The following detailed description is of the best currently contemplated modes of carrying out the invention. The description is not to be taken in a limiting sense, but is made merely for the purpose of illustrating the general principles of the invention.

The following description refers to water as an example of liquid. However, the present invention can be used with other liquids as well, such as liquid fuels (to increase economy of use), sweetwater (to counteract eutrophication), seawater (with ozone to cure fishes, or with oxygen to make the growth faster with hyperoxic environment), or with wastewater (if Bernoulli filter is added).

The system for producing water with gas bubbles enables producing gas bubbles of various sizes, including microbubbles (MB) and/or nanobubbles (NB)—preferably, the system is used to produce as much nanobubble content as possible. The gas used for the bubbles may be, for example, air, oxygen, nitrogen, hydrogen, ozone, etc., depending on the desired water properties, e.g. water with ozone bubbles is suitable for disinfection, whereas water with oxygen bubbles may be used in certain medical applications, and water with air bubbles can be used in agriculture to enhance growth. In other words, the chemical composition of gas used for providing bubbles in water depends on further activity and therefore utility of the obtained water.

Due to the developed construction of the system and the method for its use, it is possible to produce nanobubbles at a high concentration, such that the bubbles formed in water can retain for a long time in the water.

Figure 1:
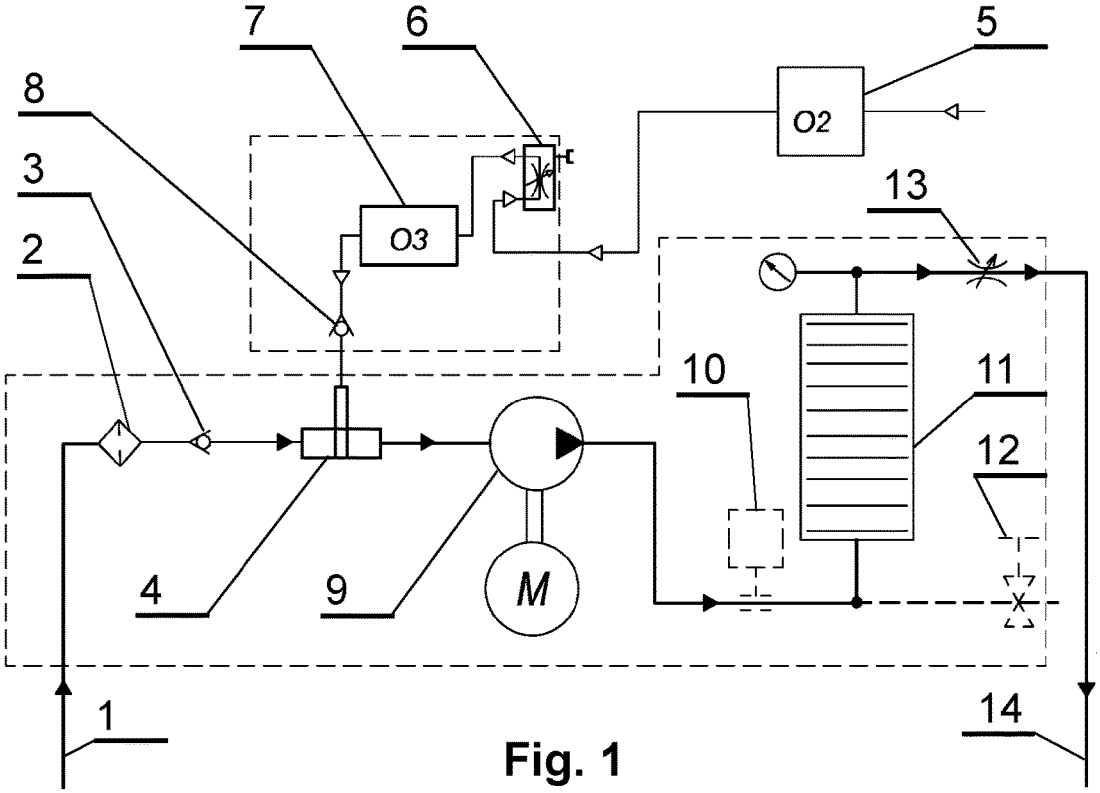
FIG. 1 presents a diagram of an embodiment of a system for producing a liquid with gas bubbles.

As shown in FIG. 1, the system comprises a liquid inlet 1 for receiving water. The water to be used as a substrate may be either conventional water such as tap water, mineral water, or purified water, such as distilled water, or deionized water, with further added cations, such as $Na^{+}$, $Ca^{2+}$, or $Mg^{2+}$. As mentioned earlier, other liquids can be used as well.

The system may comprise a filter 2 for filtering out various solid impurities suspended in water. The filter 2 can be used for example if water from a water supply system is used as the substrate. Depending on the number of solid impurities in the water, and the target purification degree, the filter 2 may be of a simple or more complex construction. For example, a known water filter of a simple construction may serve as a filter 2 in the system.

Following the filter 2, in the direction of water stream flow—shown by the arrow, the system comprises an eductor 4 for introduction of the gas stream into the water stream and mixing these two streams.

Between the filter 2 and the eductor 4 the system may comprise a check valve 3 which prevents the water after filtration to flow back into the filter, thereby reducing the risk of contamination.

Figure 4A:
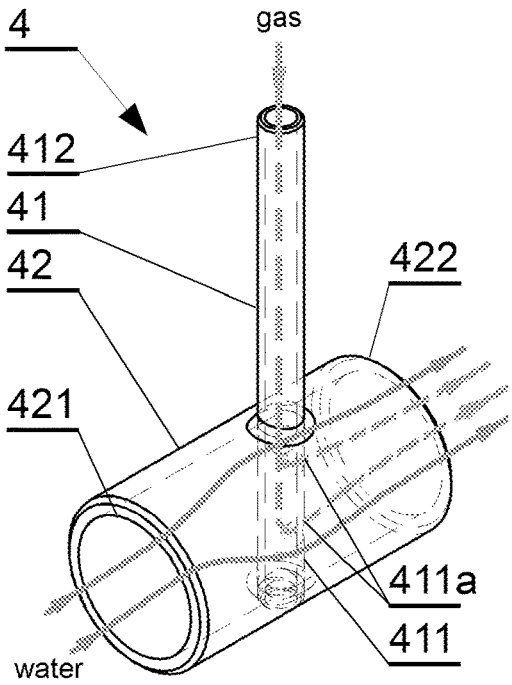
FIG. 4A presents a nozzle for mixing water and gas streams in a general view.
Figure 4B:
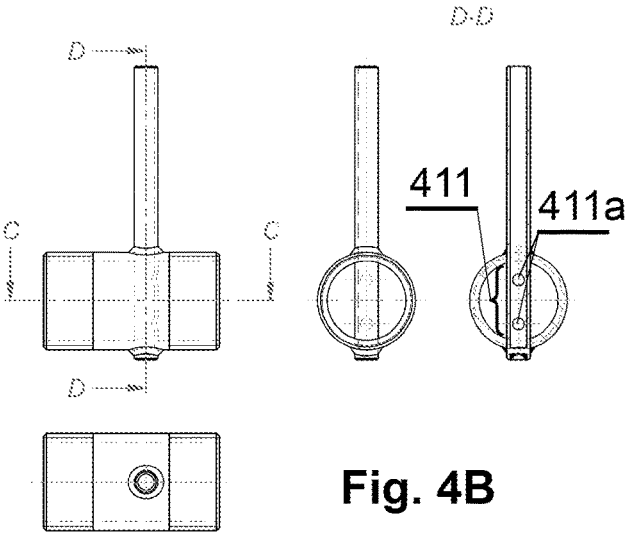
FIG. 4B presents the nozzle for mixing water and gas streams in corresponding cross-sectional views.
Figure 4C:
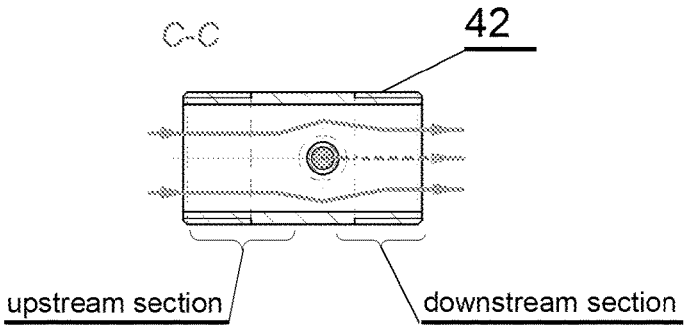
FIG. 4C present water flow in a water pipe.

The construction of the eductor 4 as used in the system is presented in details in FIGS. 4A-4C. The eductor 4 creates a negative pressure to cause suction of the gas into the water stream that constitutes a motive fluid. Thus, the eductor 4 operates in accordance with the Bernoulli principle.

The construction of the eductor 4 is such that the gas mixes with the water stream to greater extent than in conventional eductors. This allows achieving a high concentration of gas bubbles in the obtained water with a simplified process of bubbles production in a shorter time. Also, no additional pressure increase needs to be applied to obtain the increased mixing efficiency.

The eductor 4 comprises a longitudinal water pipe 42 of a substantially constant diameter. The water pipe 42 comprises an inlet 421 for the water stream at its upstream section and an outlet 422 at the downstream section for the mixed streams of water and gas. The eductor 4 further comprises a suction pipe 41 with a gas inlet 412 for supplying a gas stream. The suction pipe 41 is preferably arranged substantially vertically respective to the longitudinal axis of the water pipe 42. The suction pipe 41 comprises a suction nozzle 411 constituting a section of the suction pipe 41 arranged inside the water pipe 42 across a lumen of the water pipe 42. The suction nozzle comprises at least one opening 411*a*, and preferably two or three openings 411*a* for the gas stream sucked by the motive fluid, i.e. the water stream, into the water pipe 42. The openings 411*a* are arranged so as to face the downstream section of the water pipe 42.

The water stream and the gas stream are shown schematically in FIGS. 4A, 4B, 4C by continuous and dashed lines, respectively. The suction nozzle 411, due to its arrangement—inside the water pipe 42, across its lumen, serves as both the gas inlet—as it comprises opening(s) 411*a*) and the jet nozzle—and it creates a transverse reduction of the water pipe 42 lumen, thus the water stream flows over the suction pipe 41, as shown in FIG. 4C. The water stream after it passes the suction pipe 41, in the water pipe 42 downstream section, will entrain the gas, the low-pressure fluid, from the suction pipe 41.

Thus, within the downstream section of the water pipe 42, the water stream mixes with the gas stream, wherein the transverse arrangement of the suction nozzle 411 provides increased turbulences of water promoting mixing of water with the sucked gas. The ratio of the inner diameter of the water pipe 42 and the outer diameter of the suction pipe 41 may vary, for example, the water pipe 42 can be 24.5 mm in inner diameter, and the suction pipe 41 can be 8 mm in outer diameter which provides improved water-gas mixing in the downstream section of the water pipe 42.

Figure 2A:
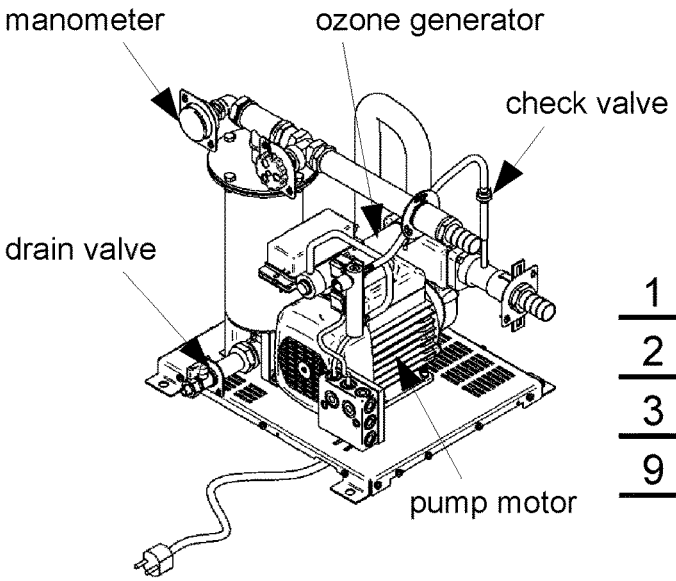
FIG. 2A presents an embodiment of a system for producing a liquid with gas bubbles in a form of 3D sketch—front view.
Figure 2B:
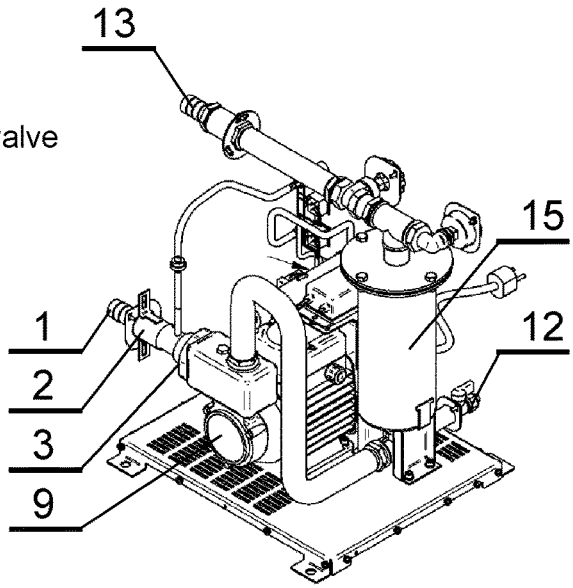
FIG. 2B presents an embodiment of a system for producing a liquid with gas bubbles in a form of 3D sketch—rear view.

The gas stream that is supplied to the gas inlet 412 of the eductor 4 can be provided from various sources. As schematically shown in FIG. 1, and FIGS. 2A, 2B, the system may comprise an ozone generator 7, e.g., comprising a corona discharge lamp for ozone production connected with an oxygen supply chamber 5 via a gas flow regulator 6. The ozone generator 7 supplies ozone as the gas for producing the bubbles. The gas can be provided to the gas inlet 412 via a check valve 8.

After leaving the eductor 4, the water-gas mixture enters an impeller pump 9. The impeller pump 9 exerts a desired flow-rate to the mixture as well as it provides additional mixing of water and gas as the water-gas mixture passes through the impeller pump 9. Using the impeller pump 9 the water-gas mixture is introduced into a mixing column 11.

Figure 5A:
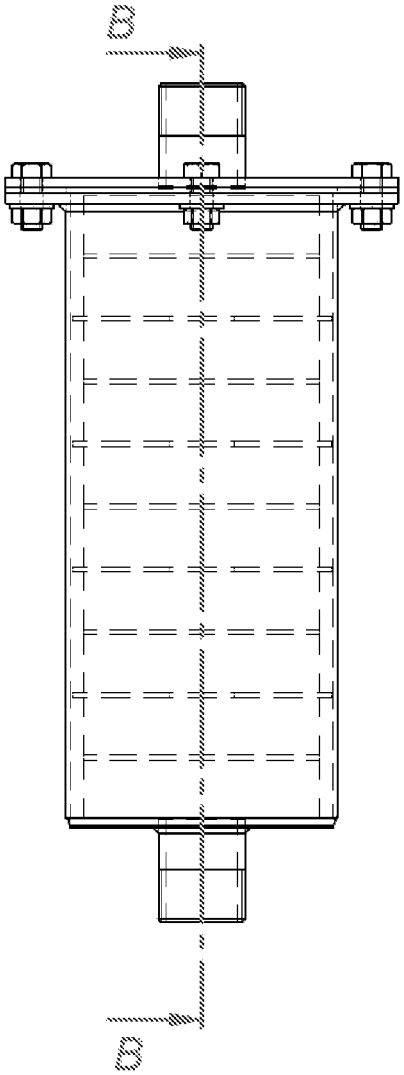
FIG. 5A presents a mixing column for generating gas bubbles in water in a general view.
Figure 5B:
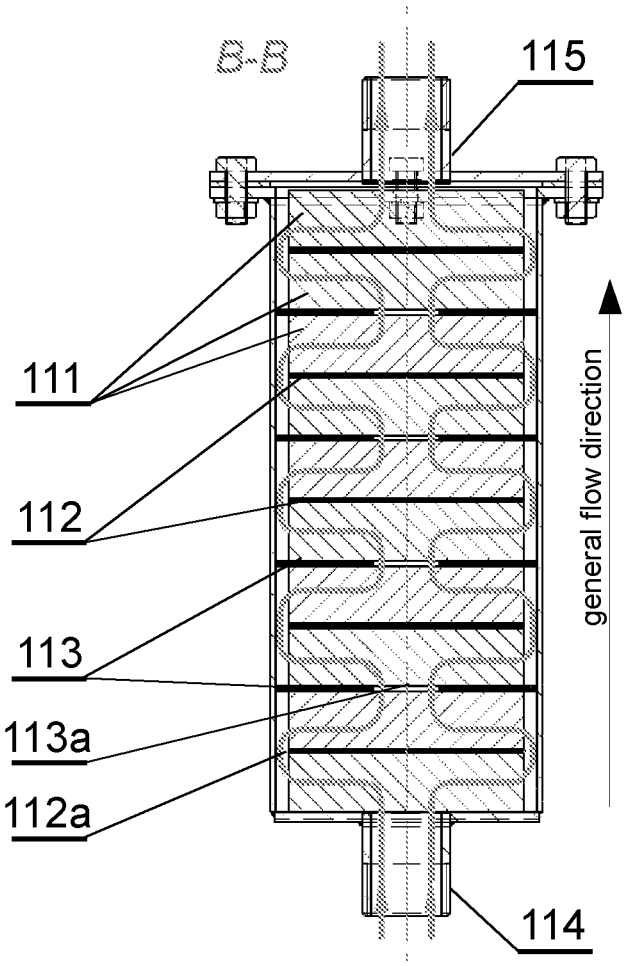
FIG. 5B presents the mixing column for generating gas bubbles in water in a cross-sectional view showing a filling of the mixing column.

The mixing column 11 is schematically shown in FIGS. 5A, 5B. Preferably, the mixing column 11 is a vertical up-flow column that has an inlet 114 at a bottom and an outlet 115 at the top. However, other arrangements and flow directions are possible as well, such as side-to-side or top-to-bottom.

The mixing column 11 comprises filing layers 111-113, an inlet 114 at its bottom and an outlet 115 at its top so that the water-gas mixture is pumped into the mixing column 15 and it passes through the filling layers 111-113 from the inlet 114 to the outlet 115 of the mixing column 11.

A water flow regulator 13 is provided downstream the outlet 115 to control the pressure of water-gas stream produced at the output of the system.

The filing layers include porous layers 111 in a form of thick cylinders separated from each other alternately by plate layers 112 and ring layers 113, so that the filling encompasses a consecutive arrangement of the layers in which each plate layer 112 is sandwiched between two porous layers 111, as well as each ring layer 113 is sandwiched between two porous layers 111, wherein simultaneously a single porous layer 111 is sandwiched between the plate layer 112 and the ring layer 113.

The porous layer 111 may be made of a ceramic material with open porosity. Preferably, the porosity of the ceramic material is from 10 to 50, or even up to 100 open pores per cubic inch. When the water with gas passes through the pores of the porous layer 111, the gas bubbles hit the walls of the pores and are divided into smaller bubbles.

The plate layer 112 has a form of a disc having an outer diameter smaller than the inner diameter of the mixing column 11, so that a clearance 112*a* is formed along the perimeter of the plate layer 112 and the column 11 inner wall. The plate layer 112 is made of an impermeable material, thereby it forms a barrier (in other words, a sealing) for the flow of water-gas mixture, and plate layer 112 directs this flow towards the clearance 112*a*. The plate layer 112 is made of a deformable material such as rubber, e.g. butadiene rubber, or PTFE (polytetrafluoroethylene). These materials make the plate layer 112 directly adhering to porous layer 111 of uneven and rugged surface, providing this way a tight connection between the plate layer 112 and the porous layer 111. Thus either rubber or PTFE may be used for the plate layer 112, as both materials exhibit sufficient flexibility with low deformation stress.

The ring layer 113 has a form of a ring having an outer perimeter which tightly fits the walls of the mixing column 11 and a flow-through aperture 113*a* arranged in its central portion, enabling the water-gas mixture to flow through the ring layer 113, via this aperture 113*a*. The ring layer 113 shall be made from a stiff material (such as steel or stainless steel) that does not deform under the pressure of the water-gas stream flowing via the column and allows to achieve longer durability and limit service. Due to the tight fitting with the walls of the mixing column and the material stiffness, the ring layers 113 provide a sable arrangement of the filling, so that the filing does not displace sideways, during the on-going process in the column 11.

The arrangement of the alternating layers 111, 112, 113, within the filing of the mixing column 11 provides an elongated path of flow of the water-gas mixture through each porous layer 111, as schematically shown in FIG. 5B by the lines with the arrows. In the mixing column 11, the pumped stream of the water-gas mixture is caused to travel from the inlet 114 to the outlet 115, through the porous layers 111, whereby the compression, expansion and vortexes are generated which allows producing gas bubbles in the water, wherein the longer the path of the flow, the smaller the diameter of the produced gas bubbles.

In one embodiment, the column 11 may comprise ten porous layers 111 provided with the alternating plate layers 112 and ring layers 113. Such structure provides the water comprising microbubbles and nanosized bubbles, as the process product received at the outlet 115. Alternatively, the system may comprise a higher mixing column 11, with a larger number of the filing layers 111, 112, 113. Alternatively, the system may comprise two or more mixing columns 11 arranged in series, which facilitates production of nanosized gas bubbles in the water. Alternatively, a plurality of columns may be used in parallel.

The construction of the mixing column 11 makes the flow direction of water-gas mixture changing over each two adjacent porous layers 111 substantially by 180°. This provides improved mixing of the water and gas, and thus a higher concentration of the gas bubbles produced in the water at the shortened distance of the ceramic material.

Therefore, the implementation of the alternating layers 112 and 113 together with their design, in which each plate layer 112 provides a peripheral clearance 112*a* and each ring layer 113 provides the central flow-through aperture 113*a*, provide a technical effect of improved mixing of water with gas inside the mixing column 11, thus enabling higher efficiency of bubble production and the reduction in dimensions of the mixing column, and thereby the dimensions of the whole system.

Figure 3A:
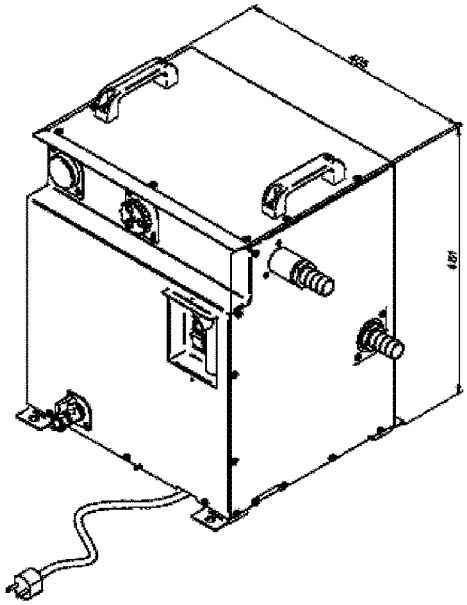
FIGS. 3A and 3B present a system for producing a liquid with gas bubbles, similar to that of from FIGS. 2A and 2B but with a housing added.
Figure 3B:
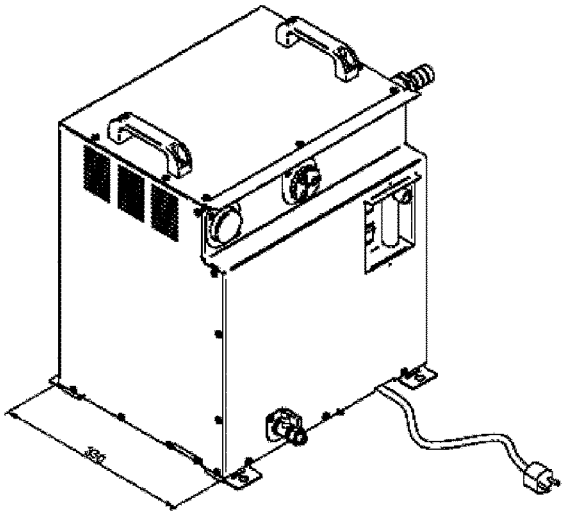

Due to the relatively small dimensions, the system has a compact construction as shown in FIGS. 2A, 2B with the visible system components, and in FIGS. 3A, 3B presenting the system with the housing. The system together with the housing may be fitted to a box of dimensions of approximately 0.5 m×0.5 m×0.5 m, thereby, it can be household and used for domestic applications, e.g. for producing water with air microbubbles and or nanosized bubbles, e.g. for drinking, cleaning, washing or plants watering.

Further, the system may preferably comprise a drain valve 12 for periodic system cleaning installed at the bottom of the mixing column 11 (FIG. 1).

Optionally, the system may further comprise an ultrasonic unit 10 for ultrasound treatment of the water-gas mixture before it enters in the mixing column 11, which provides further enhancement of the gas bubbles production in the water.

The system described herein, due to the developed construction of the eductor 4 for mixing water and gas streams and with the improved construction of the filing 111, 112, 113 of the mixing column 11 provides more compact dimensions of the system so that the system may serve for domestic applications, as well as improved efficiency of the bubbles production. In the system described herein, a high volume of gas may be introduced and effectively mixed with the water, due to the presence of the eductor 4 and the impeller pump 9—providing additional mixing step, and the construction of the mixing column 11 filing where the water-gas mixture passes extended path with additional mixing through the porous layers 111.

The above-described design of the system provides higher concentration and a smaller size of the gas bubbles produced in the water. It is also cost-efficient both in terms of manufacture and use.

The system presented herein can be used as a flow-through system, wherein gas bubbles are introduced into the water supplied at the inlet 1 and the outlet stream 14 is provided as the final product.

The system presented herein can be also used in a closed-loop system, wherein the produced water-gas stream is fed back to the inlet such that it is repeatedly passed via the system so as to increase the concentration of the bubbles and reduce the size of bubbles. In that case, the inlet 1 and the outlet 14 of the system can be connected to a water tank which contains water to which bubbles are to be introduced.

The system is used such that first the water and gas flows are initiated and next the regulators 6 and 13 and the pump 9 are controlled such as to obtain an optimal ratio of the gas volume, water volume and water-gas stream pressure. In practice, when nanobubbles of high concentration are generated, the outlet water-gas stream will have a milky appearance, and it will become clarified after some time (due to larger bubbles that flotate to the surface, while the nanobubbles remain present in the whole volume of the water). Preferably, the produced water-gas stream contains nanobubbles having a size of about 50 nm or about 150 nm.

The preferred flow rates providing formation of microbubbles and nanobubbles of gas in water are as follows:

- the flow rate of the water stream at the liquid inlet 1: 25-35 l/min
- the flow rate of the gas stream at the inlet to the suction pipe 41: 0.4-0.8 l/min
- the pressure of the water (or water-gas mixture) maintained within the mixing column 15 between its inlet 114 and outlet 115: 3.8 to 4.8 bars.

However, larger system can be made in accordance other embodiments, such as having a water stream rate of above 100 l/min.

The above conditions provide production of water-gas stream with a concentration of nanobubbles even up to 200 million per milliliter.

For example, the mixing column 11 may include 10 porous layers 111 having a height of 22 mm and a diameter of 90 mm, plate layers 112 of a diameter of 90 mm and ring layers 113 of external diameter of 99 mm and internal aperture of 25 mm diameter, all placed in the cylindrical mixing column 11 having internal diameter of 99 mm.

While the invention has been described with respect to a limited number of embodiments, it will be appreciated that many variations, modifications and other applications of the invention may be made. Therefore, the claimed invention as recited in the claims that follow is not limited to the embodiments described herein.

The invention claimed is:

1. A system for producing a liquid with gas bubbles, the system comprising:
- a liquid inlet to receive a liquid stream,
- a gas inlet to receive a gas stream,
- an eductor configured to mix the liquid stream and the gas stream to a form of a liquid-gas mixture, and
- a mixing column comprising:
  - an input configured to receive the liquid-gas mixture from the eductor,
  - an output, and
  - a stack of filling layers positioned between the input and the output, configured to reduce a size of gas bubbles within the liquid-gas mixture as it flows from the input to the output, the stack of filling layers comprising a plurality of porous layers separated alternately by:
    - plate layers made of a first impermeable material, each plate layer having a shape of a plate distanced by a clearance from an internal wall of the mixing column to allow the liquid-gas mixture to flow from one porous layer to its neighboring porous layer via the clearance, and
    - ring layers made of a second impermeable material, each ring layer having a form of a ring that has a central flow-through aperture to allow the liquid-gas mixture to flow from one porous layer to its neighboring porous layer via the aperture.

2. The system according to claim 1 wherein the ring layers are made of steel.

3. The system according to claim 2 wherein the ring layers are made of stainless steel.

4. The system according to claim 1 wherein the plate layers are made of rubber.

5. The system according to claim 1 wherein the plate layers are made of polytetrafluoroethylene (PTFE).

6. The system according to claim 1 wherein the mixing column comprises from 2 to 10 porous layers.

7. The system according to claim 1 wherein the eductor comprises:

a liquid pipe having an upstream section connected to the liquid inlet and a downstream section having an outlet to discharge the liquid-gas mixture; and a suction pipe having an upstream section connected to the gas inlet and a suction nozzle arranged in the liquid pipe across a lumen of the liquid pipe, wherein the suction nozzle comprises at least one opening facing the downstream section of the liquid pipe.

8. The system according to claim 1, further comprising an impeller pump configured to pump the liquid-gas mixture from the eductor into the mixing column.

9. The system according to claim 1, further comprising a filter arranged at the liquid inlet to filter the liquid stream.

10. A method for producing a liquid with gas bubbles, the method comprising the steps of:

providing a liquid stream, providing a gas stream, mixing the liquid stream and the gas stream in an eductor to obtain a liquid-gas mixture, passing the liquid-gas mixture via a mixing column, the mixing column comprising:

an input configured to receive the liquid-gas mixture from the eductor, an output, and a stack of filling layers positioned between the input and the output, configured to reduce a size of gas bubbles within the liquid-gas mixture as it flows from the input to the output, the stack of filling layers comprising a plurality of porous layers separated alternately by:

plate layers made of a first impermeable material, each plate layer having a shape of a plate distanced by a clearance from an internal wall of the mixing column to allow the liquid-gas mixture to flow from one porous layer to its neighboring porous layer via the clearance, and ring layers made of a second impermeable material, each ring layer having a form of a ring that has a central flow-through aperture to allow the liquid-gas mixture to flow from one porous layer to its neighboring porous layer via the aperture.

11. The method according to claim 10, comprising passing the liquid-gas mixture via the mixing column in a flow-through manner.

12. The method according to claim 10, comprising passing the liquid-gas mixture via the mixing column in a closed-loop manner.

13. The method according to claim 10, comprising passing the liquid-gas mixture via the mixing column with a pressure sufficient to cause division and multiplication of gas bubbles as the liquid-gas mixture passes through the porous layers.

14. The method according to claim 10, comprising passing the liquid-gas mixture via the mixing column such that compression, expansion and vortexes are generated within the liquid-gas mixture to produce gas bubbles in the water.

* * * * *